US006349831B1

(12) United States Patent
Buss

(10) Patent No.: US 6,349,831 B1
(45) Date of Patent: Feb. 26, 2002

(54) CHILD-RESISTANT PRODUCT PACKAGE

(75) Inventor: Michael Buss, Allentown, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 0 days.

(21) Appl. No.: 09/609,719

(22) Filed: Jun. 30, 2000

(51) Int. Cl.[7] ..... B65D 83/04

(52) U.S. Cl. ..... 206/531; 206/807; 206/1.5; 220/345.1; 220/281

(58) Field of Search ..... 206/528, 530–539, 206/807, 1.5; 220/281, 836, 837, 345.1, 345.2, 345.3, 345.4

(56) References Cited

U.S. PATENT DOCUMENTS

| | | | | | |
|---|---|---|---|---|---|
| 3,888,350 | A | | 6/1975 | Horvath | |
| 4,113,098 | A | | 9/1978 | Howard | |
| 4,126,224 | A | * | 11/1978 | Laauwe | 206/540 |
| 4,192,422 | A | | 3/1980 | Kotyuk | |
| 4,364,488 | A | | 12/1982 | Anjou | |
| 4,401,210 | A | | 8/1983 | Anjou | |
| 4,561,544 | A | * | 12/1985 | Reeve | 206/540 |
| 4,844,284 | A | | 7/1989 | Drozd et al. | |
| 4,974,729 | A | * | 12/1990 | Steinnagel | 206/531 |
| 5,080,222 | A | * | 1/1992 | McNary | 206/1.5 |
| 5,082,137 | A | | 1/1992 | Weinstein | |
| 5,275,291 | A | | 1/1994 | Sledge | |
| 5,323,907 | A | * | 6/1994 | Kalvelage | 206/531 |
| 5,346,069 | A | * | 9/1994 | Intini | 206/531 |
| 5,437,371 | A | * | 8/1995 | Lataix | 206/539 |
| 5,489,025 | A | * | 2/1996 | Romick | 206/531 |
| 5,878,887 | A | * | 3/1999 | Parker et al. | 206/528 |
| 6,021,901 | A | * | 2/2000 | Wolfe | 206/531 |
| 6,024,222 | A | * | 2/2000 | Friberg et al. | 206/531 |
| 6,047,829 | A | | 4/2000 | Johnstone et al. | |

FOREIGN PATENT DOCUMENTS

| | | |
|---|---|---|
| WO | WO 00/15518 | 3/2000 |

* cited by examiner

*Primary Examiner*—Mickey Yu
*Assistant Examiner*—Jila M. Mohandesi
(74) *Attorney, Agent, or Firm*—Dechert; Daniel S. Goldberg

(57) ABSTRACT

The invention relates to child-resistant package having a shell with a first locking part and a tray having blister card coupled to a tether having a second locking part. In a closed position the first locking part engages the second locking part to limit the movement of the tray relative to the shell. A release part is provided and is operable to disengage the first and second locking parts and free the tray to move from the closed position to an open position.

10 Claims, 6 Drawing Sheets

CHILD-RESISTANT PRODUCT PACKAGE

The present invention relates to packaging for pharmaceutical products and the like and in particular relates to the field of child-resistant product packaging.

It is generally known that pharmaceutical products can be distributed in a variety of forms. Single dose pharmaceutical products are commonly available in tablets, lozenges, capsules and the like. It is also known that some pharmaceutical products can pose a health risk to young children who are unable to recognize the risks if such products are ingested.

Accordingly, it is desirable to provide child-resistant pharmaceutical product packaging which prevents a child from accessing the product yet provides access to adults. To this end, various types of child-resistant packaging has been developed.

Many older designs incorporated sliding drawers (having a bottom and four sides) slidably engaged in a housing. See for example U.S. Pat. No. 3,888,350—Horvath, U.S. Pat. No. 4,113,098—Howard, U.S. Pat. No. 4,364,488—Anjou III, U.S. Pat. No. 4,401,210—Anjou II, U.S. Pat. No. 4,844,284—Drodz et al., U.S. Pat. No. 5,080,222—McNary, U.S. Pat. No. 5,082,137—Weinstein and U.S. Pat. No. 5,275,291—Sledge.

U.S. Pat. No. 6,047,829—Johnstone et al. discloses a two piece paperboard package that houses a unit dose product. In one embodiment, the package has an outer paperboard shell formed with a cut away and a release button. This paperboard shell must be folded and glued in a separate manufacturing step The unit dose product is carried on an inner slide card formed with a folded extension that is inserted in the paperboard shell (closed position). In operations, the folded extension contacts the cut away formed in the paperboard shell when the inner slide card is moved outward. This prevents removal of the inner slide card. The inner slide card is released by pressing the release button which deflects the folded extension thereby preventing the folded extension from contacting the cut away.

Improved structures for packaging single dose pharmaceutical products are desired. In general it would be desirable to provide a packaging structure which is simple to manufacture and assemble and yet provides enhanced security features.

SUMMARY OF THE INVENTION

The invention relates to child-resistant package having a shell with a first locking part and a tray having blister card coupled to a tether having a second locking part. In a closed position the first locking part engages the second locking part to limit the movement of the tray relative to the shell. A first release part is provided and is operable to disengage the first and second locking parts and free the tray to move from the closed position to an open position. The blister card is preferably hingably coupled to the tether. In a preferred embodiment, the blister card is coupled to the tether by an ultrasonic weld.

Another aspect of the invention provides a child-resistant wherein the shell has a third locking part and the tray has a fourth locking part. In a closed position the third locking part engages the fourth locking part to limit the movement of the tray relative to the shell. A second release part is provided and is operable to disengage the third and fourth locking parts and free the tray to move from the closed position to an open position. The first, second, third and fourth locking parts must be disengaged to free the tray to move from the closed position to an open position.

Another aspect of the invention provides a shell with a top and bottom, the bottom having at least one side formed with a groove operable to cooperate with the blister card.

DETAILED DESCRIPTION OF THE INVENTION

The invention concerns a child-resistant package, having a shell with at least one locking part (e.g. locking projection) and a tray having at least one corresponding locking part (e.g., an outwardly biased tab). In a closed position the outwardly biased tab engages the locking projection to limit the movement of the tray relative to the shell. The shell also has at least one release part (e.g., the shell is resiliently deformable and can be displaced inwardly at a location adjacent to the locking projection) to disengage the outwardly biased tab from the locking projection freeing the tray to move from the closed position to an open position. The tray is generally operative to store pharmaceutical products that are inaccessible with the tray in the closed position. The term pharmaceutical product is used herein its broadest sense and includes medicaments and non-medicaments such as vitamins, minerals, herbs, extracts and the like.

Figure 1:
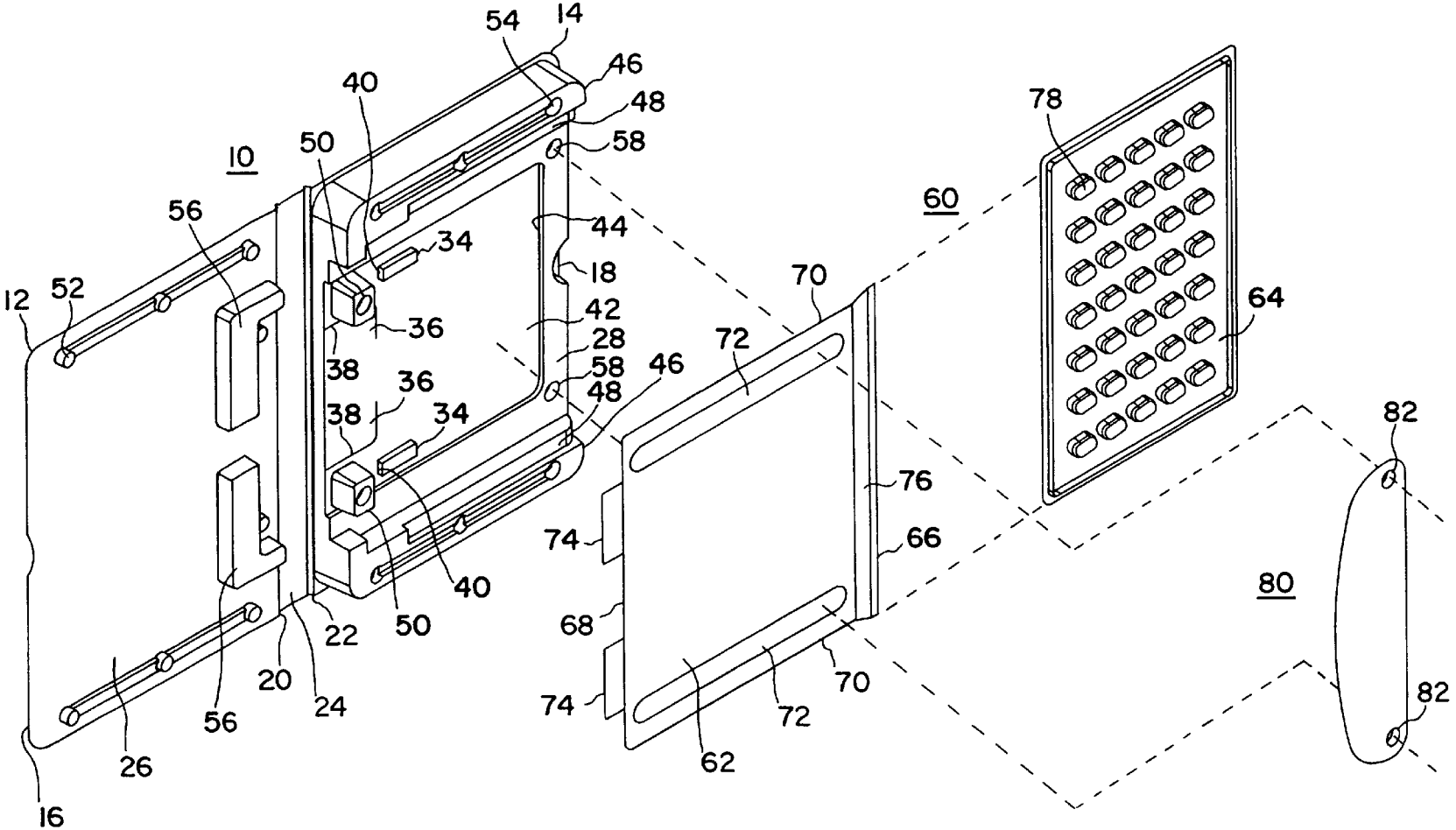
FIG. 1 is explodes perspective view of a child-resistant package in accordance with the invention.
Figure 2:
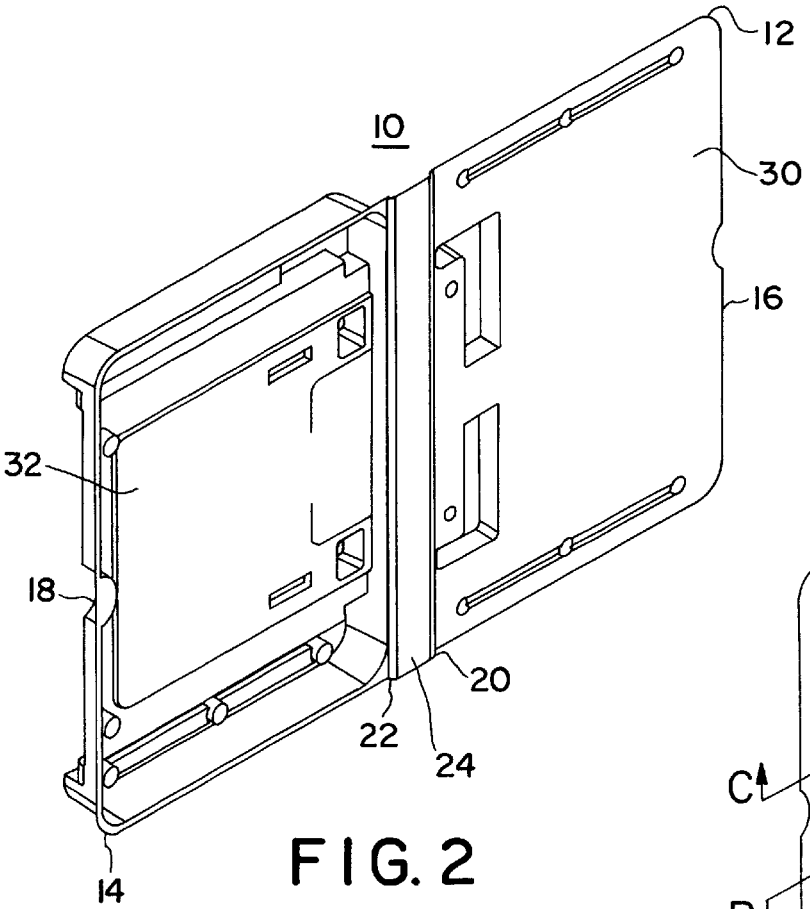
FIG. 2 is a perspective view showing the outer surfaces of the top and bottom of a child-resistant package shell in accordance with the invention.

FIG. 1 is an exploded perspective view of a child-resistant package in accordance with the invention. The package generally has a shell 10, a tray 60 and a keeper 80. The shell has a top 12 and bottom 14 each having front edges 16, 18 spaced apart from rear edges 20, 22, (defining the depth of the shell). In a preferred embodiment, the top and bottom are coupled by rear wall 24, hingedly attached to the rear edges 20, 22 of the top and bottom. The top and bottom each have an inner surface 26, 28 and an outer surface 30, 32 (See FIGS. 2 and 3).

The bottom is formed with two locking projections 34 each having an associated deformable area 36 generally defined by a slot 38 formed in the bottom. The locking projections each have a front surface 40 which cooperates with an outwardly biased tab coupled to the tray as discussed in detail below. Slot 38 is generally show having an L shaped profile thereby defining a roughly triangular deformable area. It is understood that various profile slots are acceptable for use in accordance with the invention such as lines, arcs and/or combinations and permutations thereof.

In preferred embodiment, the bottom is formed with depression 42 having a lip 44 that is substantially parallel with the front edge 18 of the bottom. The lip 44 also cooperates with the outwardly biased tab coupled to the tray as discussed in detail below. The bottom has two sides 46 that are spaced apart thereby defining the useable width of the shell. Each side is formed with a groove 48. The bottom also has two support posts 50 which are operable to support the top 12.

The top 12 is generally formed to mate with the bottom thereby defining at least a partial enclosure. The top and bottom are generally attachable using interlocking fasteners 52, 54. It is understood that various fasteners and/or fastening methods are acceptable for use in accordance with the invention, including but not limited to various combinations of male and female fasteners, adhesives, welds, rivets and the like. The top is formed with two ribs 56 that generally cooperate with the tray as discussed in detail below.

Tray 60 as shown in FIG. 1 is generally formed of a tether 62 and blister card 64. Preferably, the tray 60 is dimensioned to fit substantially inside the shell (i.e., smaller than the depth and useable width of the shell). The tether 62 generally has front and rear edges 66, 68, sides 70 and is formed with two longitudinal slots 72 and two tabs 74. It is generally understood that the tether can be formed with one or more slots 72. For improved lateral stability in the slidable motion of the tether, the tether is preferably formed with at least two slots.

Preferably the tether is formed of high quality paperboard such as solid bleached sulfate. In the alternative, the tether can be formed of a plastic material such as PVC, PVdC, Aclar, PP or PE, or the like. In a preferred embodiment, the shell and tether are dimensioned to receive standard size blister cards. This advantageously provides standard packaging components that need not be re-designed to accommodate a wide range of pharmaceutical products. Further, the invention makes available child resistant packaging with little or no required modification of currently available blister card configurations.

The front edge 66 of the tether 62 is preferably formed with a hingable lip 76 that is couplable to the blister card 64. The blister card is preferably formed of plastic material such as PVC, PVdC, Aclar, PP or PE, or the like. The blister card is preferably attached to the tether by ultrasonic welding or the like. The process of ultrasonic welding generally proceeds as follows; the blister card is generally positioned with one edge overlapping a corresponding edge of the tether; an ultrasonic horn is driven down and actuated to perform the weld, thereby forming a seam permanently joining the blister card to the tether.

It has generally been determined that a preferred seam width is approximately 8 mm or less. The seam is preferably spaced apart from the nearest pharmaceutical product contained in the blister card by at least 12 mm. It has also been determined that typical ultrasonic exposure time should be less that 2 seconds. It is submitted that particular ultrasonic frequency, power levels and other operating parameters are well within the grasp of those skilled in the art. In the alternative the blister card can be joined to the tether by an adhesive, bonding agent or any other means known in the art.

The blister card 64 is generally operable to hold a quantity of a pharmaceutical products (e.g., a plurality tablets or the like) and has a structure which is generally known in the art. The blister card is generally dimensioned to fit within the depth and useable width of the shell 10. In a preferred embodiment, the blister card is dimensioned to fit within the grooves 48 formed in the sides 46 of the bottom 14. The structure of blister card 64 is generally known in the art. In essence, any generally planar structure for storing and dispensing pharmaceutical products is compatible with the invention. Accordingly, blister card 64 is shown only generally as having an upper sheet formed with plurality resilient hollow blisters each operable to receive a pharmaceutical product (e.g., a tablet or the like). The blister card 64 also has a backing sheet operable to separate, rupture or otherwise release the pharmaceutical product (e.g., upon application of pressure to the blister 78).

The rear edge 68 of the tether 62 is formed with two tabs 74 that cooperate with the locking projections 34 formed in the shell 10. In general, the tabs are hingably attached to the tether 62 and are bent downward (i.e., towards to bottom of the shell) thereby forming an acute angle with respect to the body of the tether 62. See FIGS. 11–13 discussed in detail below.

The tray 60 is slidably retained in the shell 10 by keeper 80. In general keeper 80 is formed with a pair of fasteners 82 that mate with complementary fasteners 58 in the shell 10 thereby coupling the keeper to the shell. The fasteners 82 are generally dimensioned to pass through the slots 72 in the tether 62 thereby slidably retaining the tray in the shell. Fasteners 82 and 58 are generally shown as a interlocking mnale/female fasteners (e.g., generally cylindrical in profile). It is understood that either the shell 20 or the keeper 80 can be formed with a female fastener so long as the other is formed with a male fastener. In a preferred embodiment, keeper 80 is a formed as a single member. It is understood that keeper 80 can be formed as a separate structure, one keeper (each having a fastener 82) for each slot. It is also understood that various geometric fastener profiles are compatible with the invention so long as the fastener is operable to pass through slots 72.

Figure 5:
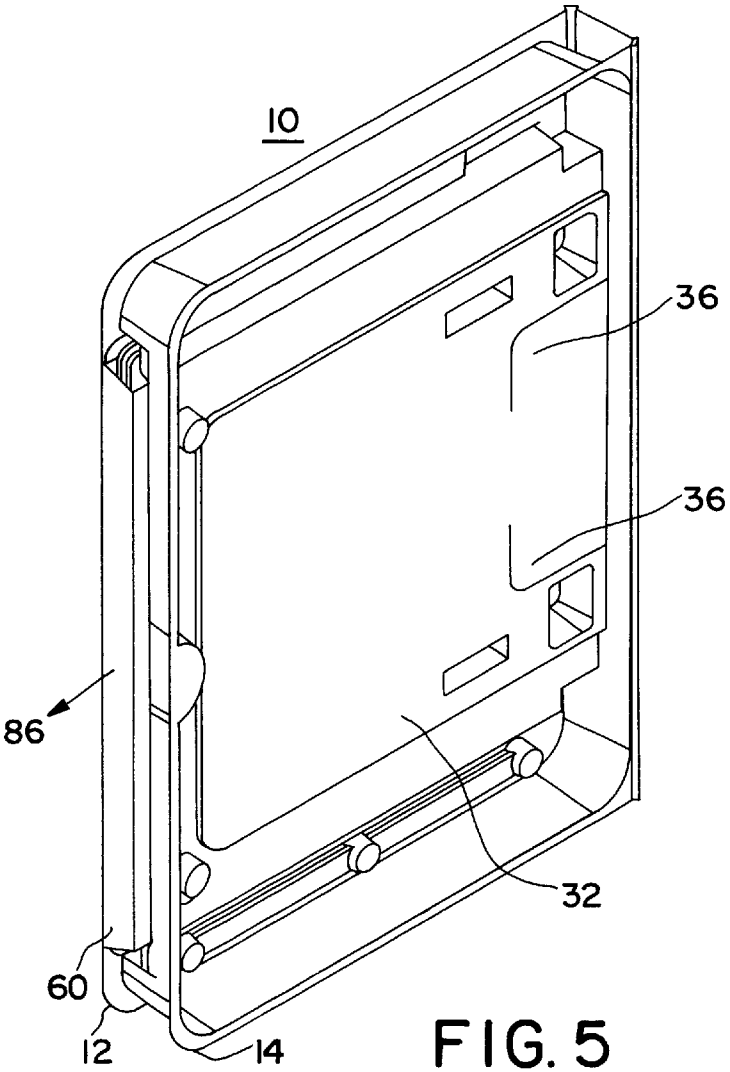
FIG. 5 is a perspective view showing the bottom of a child-resistant package shell in accordance with the invention.
Figure 4:
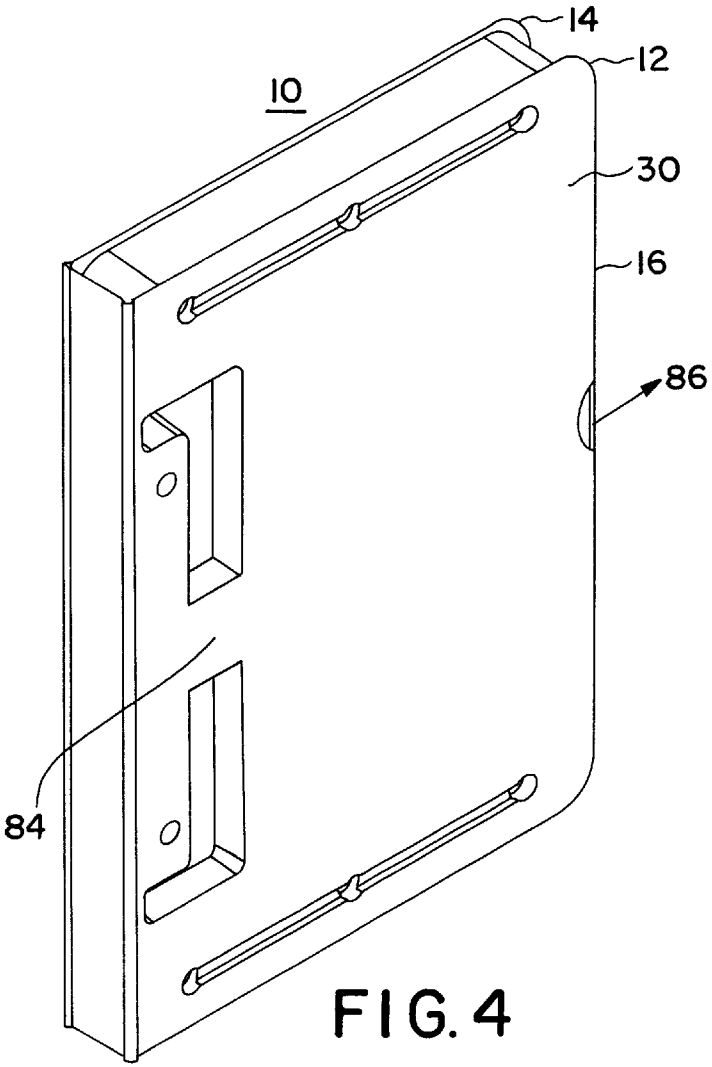
FIG. 4 is a perspective view showing the top of a child-resistant package shell in accordance with the invention.
Figure 7:
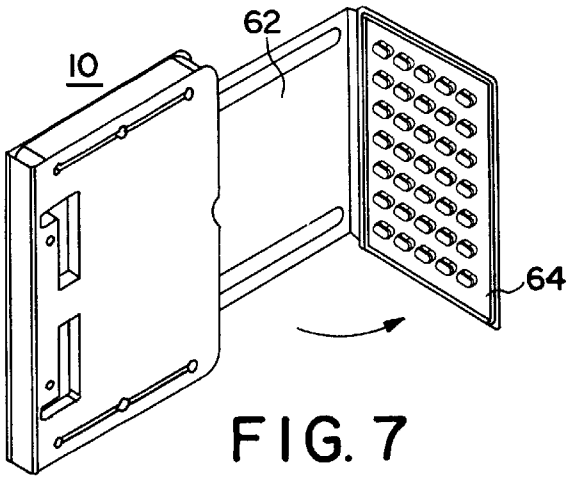
FIG. 7 is a perspective view showing the top of a child-resistant package shell with the blister card removed from the shell and unfolded in accordance with the invention.
Figure 8:
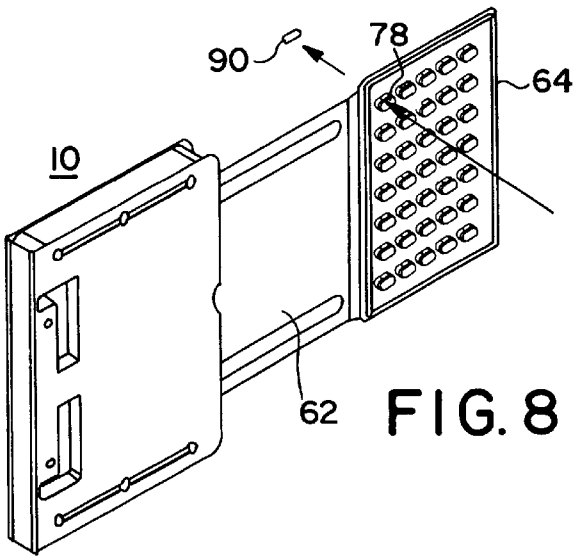
FIG. 8 is a perspective view showing the top of a child-resistant package shell with the blister card removed from the shell and unfolded and a removed pharmaceutical product in accordance with the invention.
Figure 6:
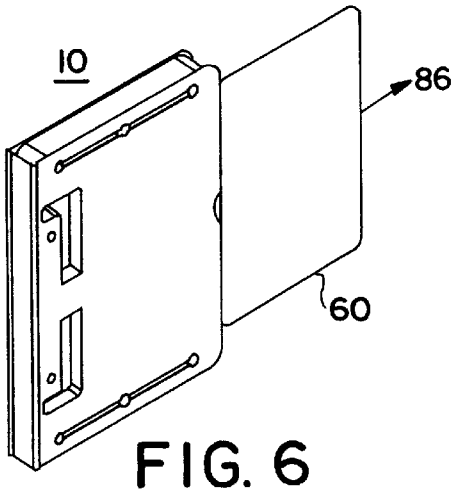
FIG. 6 is a perspective view showing the top of a child-resistant package shell with the blister card being removed from shell in accordance with the invention.
Figure 10:
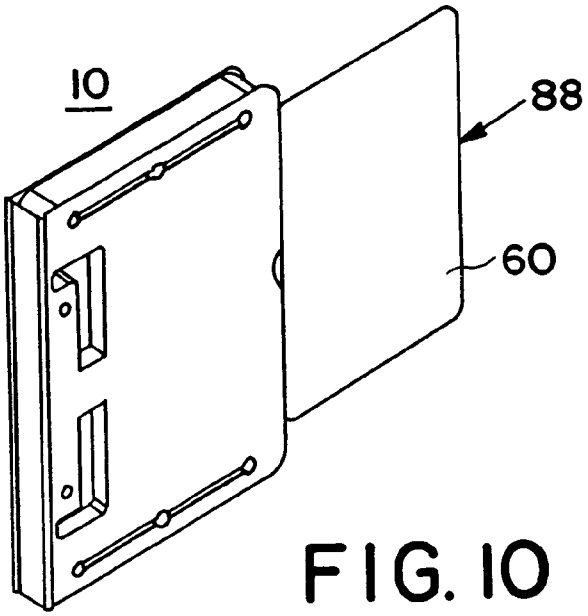
FIG. 10 is a perspective view showing the top of a child-resistant package shell with the blister card being inserted into the shell in accordance with the invention.
Figure 9:
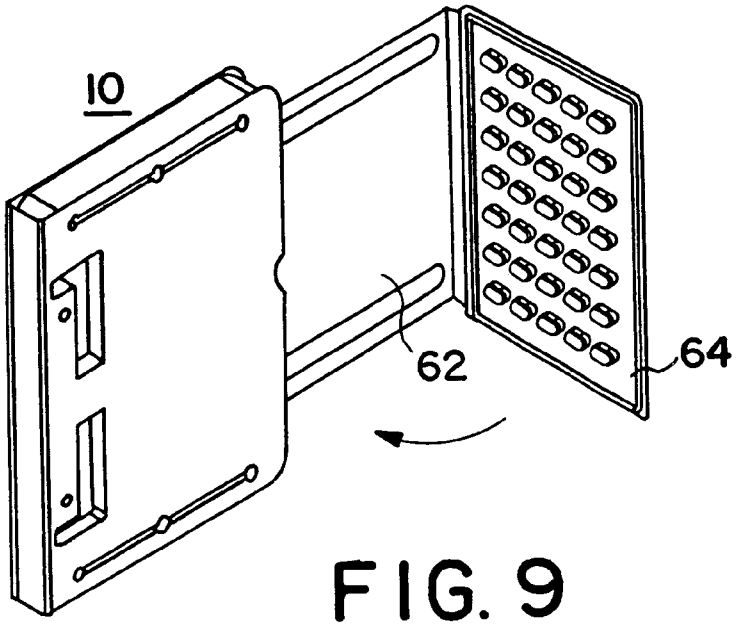
FIG. 9 is a perspective view showing the top of a child-resistant package shell with the blister card extended and being folded in accordance with the invention.

FIGS. 4–10 generally show the operation of the invention. FIGS. 4 and 5 show top and bottom views of the shell with the tray 60 in a locked and closed position. The tray is disengaged or unlocked by manually applying pressure to deformable areas 36. For example, an individual can apply pressure to deformable areas 36 by using one hand, placing one finger on each deformable area on the bottom 14 and the thumb in an opposing area 84 on the top 12 and then squeezing the tray 10. This causes the deformable areas 36 to deflect and extend into the shell and contact the tabs 74. Once pressure is applied to both deformable areas 36, the tray is unlocked and can be pulled out of the shell (i.e., pulled in a direction shown by arrow 86) into an open position. FIG. 6 shows the tray 60 removed from the shell 10 (i.e., unlocked and in an open position). In order to access the pharmaceutical product 90, the tray is unfolded revealing the blister pack 64 and shown in FIG. 7. The pharmaceutical product 90 can be removed by conventional methods as shown in FIG. 8. Once the pharmaceutical product 90 is removed the tray 60 is folded and pushed into the shell (i.e., pushed in a direction shown by arrow 88).

Thus, in a preferred embodiment, the invention requires simultaneous pressure applied to both release parts (e.g., deformable areas 36) in order to release or unlock the tray 60. This advantageous in that young children often lack the manual dexterity to simultaneously apply and hold pressure to both deformable areas 36 while pulling the tray 60 outward.

As an added safety precaution the distance between deformable areas 36 can be increased. Increasing the spacing between deformable areas 36 further limits young children from unlocking the tray by exceeding the reach of the child's fingers or usable grip range. It is believed that deformable areas spaced apart in the range of 3–8 cm are acceptable for use in accordance with the invention.

Security can be further enhanced by adjusting the pressure required to operate deformable areas 36. For example slots 38 can be omitted to maximize the pressure required to deflect the shell inward to contact the tabs 74. In the alternative, different length and shaped slots can be used. For example, slots 38 can be straight (for increased resistance) or U shaped (for decreased resistance). Other geometric profile shapes for slots 38 are also possible without departing from the invention.

Figure 3:
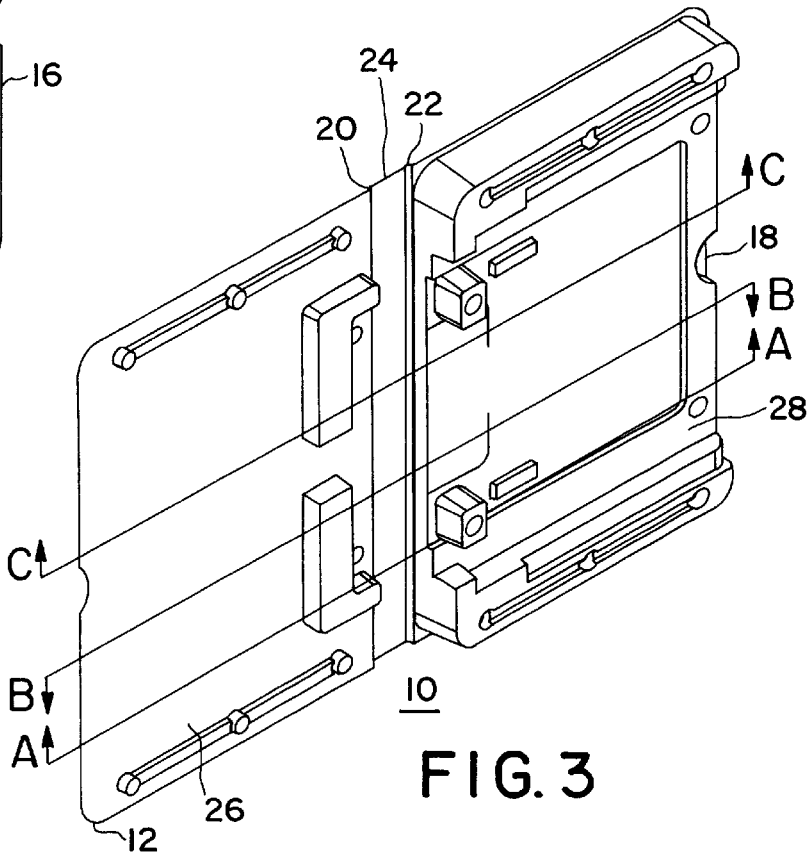
FIG. 3 is a perspective view showing the inner surfaces of the top and bottom of a child-resistant package in accordance with the invention.
Figure 11:
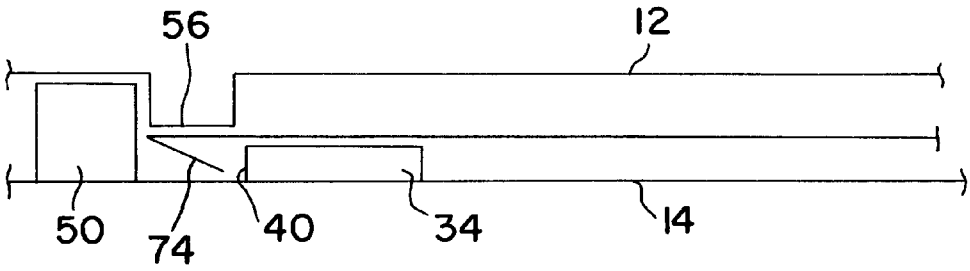
FIG. 11 is a side sectional view of a strip taken along AA and BB as shown in FIG. 3 showing the relationship between the inner surface of the bottom of a child-resistant package shell and tether in a locked and closed position in accordance with the invention.
Figure 12:
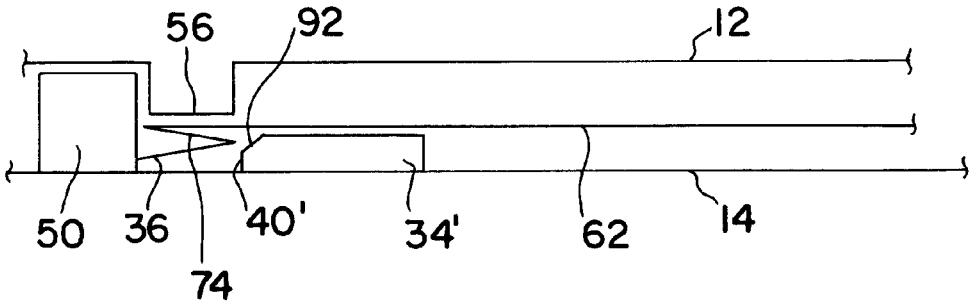
FIG. 12 is a side sectional view of a strip taken along sections AA and BB as shown in FIG. 3 showing the relationship between the inner surface of the bottom of a child-resistant package shell and tether in an unlocked and closed position in accordance with the invention.

FIGS. 11 and 12 are side sectional views of a strip taken along AA and BB as shown in FIG. 3 and generally show the relationship between locking projection 34 and tab 74 in locked and unlocked positions. As shown in FIG. 11 (the locked position), the tether 62 is generally coplanar with the bottom 14. The tab 74 is hingably attached to the tether 62 and is bent downward (i.e., towards to bottom of the shell) thereby forming an acute angle with respect to the body of the tether 62. The rib 56 generally cooperates with the tray preventing the tab from unfolding if tray is pulled outward.

With reference to FIG. 12, the tray is unlocked by applying pressure to deformable area 36 thereby causing the deformable area 36 to deflect and extend into the shell and contact tab 74. Tab 74 is generally compressed upward (i.e., towards the top of the shell 12) such that the tab 74 is raised above the front surface 40 of the locking projection 34. As shown in FIG. 12, the front surface 40' of the locking projection 34' can be at least partially beveled (shown by arrow 92). A beveled front surface 40' is advantageous since it generally facilitates unlocking. Generally, the tab 74 need only be compressed so that it contacts the bevel. The tab 74 will be deflected and further compressed by the bevel during removal.

Figure 13:
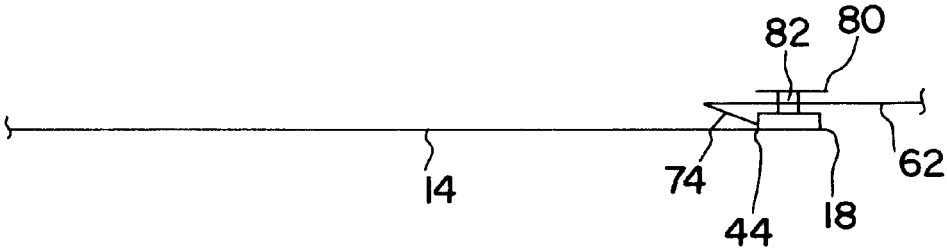
FIG. 13 is a side sectional view taken along section CC as shown in FIG. 3 showing the relationship between the lip formed in the bottom of a child-resistant package shell and tether in an unlocked and open position in accordance with the invention.

FIG. 13 is a side sectional view taken along section CC as shown in FIG. 3 showing the tray 60 in an unlocked and open position. For matters of simplicity, a portion of the lip 44 that is generally parallel to the side 46 has been omitted from FIG. 13. In general, the tray can only be extended until the keeper 80 contacts the end of the slot 72 at the rear edge of the tether 68. However, the invention also provides a secondary locking structure. The bottom 14 of the shell 10 is formed with a depression 42 having a lip 44. In a preferred embodiment, with the tray in an open position and fully extended, tab 74 contacts lip 44 thereby also preventing removal of the tray. The depression generally provides structural rigidity of the bottom 14 and the lip formed by the depression also provides a secondary locking benefit, greatly strengthening the overall package.

ADVANTAGES OF THE INVENTION

Numerous advantages are provided by employing the present invention, a non-exhaustive list is disclosed below. The present invention provides a simple and effective structure for securing blister packaged pharmaceutical products. The invention also provides a clamshell housing particularly suited for thermoforming from sheet plastic. The invention also provides a clamshell housing which generally encloses a tray formed of a tether and blister card operable to store a pharmaceutical product. The invention also provides a packaging structure compatible with existing blister packaging technology. The invention also provides a packaging structure having a standard shell and tether that can work in concert with existing blister card formats to provide child-resistant packaging for a wide range of pharmaceutical products. The invention also provides a tray formed with a tether having a locking part that is uniquely couplable to existing blister cards for incorporation into child-resistant packaging. These and other advantages are readily apparent, the scope of the invention as claimed is by no means limited to or by the precise advantages recited above.

All publications and references, including but not limited to patents and patent applications, cited in this specification are herein incorporated by reference in their entirety as if each individual publication or reference were specifically and individually indicated to be incorporated by reference herein as being fully set forth. Any patent application to which this application claims priority is also incorporated by reference herein in its entirety in the manner described above for publications and references.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed:

1. A child-resistant package, comprising:

shell having a first locking part;

a tray having blister card coupled to a tether, wherein the tether has a second locking part and wherein in a closed position the first locking part engages the second locking part to limit the movement of the tray relative to the shell; and a first release part operable to disengage the first and second locking parts and free the tray to move from the closed position to an open position.

2. The child-resistant package of claim 1, wherein the blister card is hingably coupled to the tether.

3. The child-resistant package of claim 1, wherein the blister card is coupled to the tether by an ultrasonic weld.

4. The child-resistant package of claim 1, wherein the shell has a third locking part and the tray has a fourth locking part and wherein in a closed position the third locking part engages the fourth locking part to limit the movement of the tray relative to the shell and a second release part is operable to disengage the third and fourth locking parts and free the tray to move from the closed position to an open position.

5. The child-resistant package of claim 1, wherein the shell has a top and bottom and the bottom has at least one side formed with a groove operable to cooperate with the blister card.

6. A child-resistant package, comprising:

a shell having first and third locking parts;

a tray having a blister card coupled to a tether, wherein the tether has second and fourth locking parts and wherein in a closed position the first locking part engages the second locking part and the third locking part engages the fourth locking part to limit the movement of the tray relative to the shell;

a first release part operable to disengage the first and second locking parts; and a second release part operable to disengage the third and fourth locking parts; wherein the first, second, third and fourth locking parts must be disengaged to free the tray to move from the closed position to an open position.

7. The child-resistant package of claim 6, wherein the blister card is hingably coupled to the tether.

8. The child-resistant package of claim 6, wherein the blister card is coupled to the tether by an ultrasonic weld.

9. The child-resistant package of claim 6, wherein the shell has a top and bottom and the bottom has at least one side formed with a groove operable to cooperate with the blister card.

10. A child-resistant package, comprising:

a shell having a top and bottom joined to form at least a partial enclosure, the shell having first and third locking parts and first and second release parts; and a tray having a blister card coupled to a hingable lip of a tether by an ultrasonic weld, the tether having second and fourth locking parts, wherein in a closed position the first locking part engages the second locking part and the third locking part engages the fourth locking part to limit the movement of the tray relative to the shell, and wherein the first release part is operable to disengage the first and second locking parts and the second release part is operable to disengage the third and fourth locking parts, and wherein the first, second, third and fourth locking parts must be disengaged to free the tray to move from the closed position to an open position.

* * * * *

UNITED STATES PATENT AND TRADEMARK OFFICE

CERTIFICATE OF CORRECTION

PATENT NO. : 6,349,831 B1
DATED : February 26, 2002
INVENTOR(S) : Michael Buss

It is certified that error appears in the above-identified patent and that said Letters Patent is hereby corrected as shown below:

Column 6,
Line 55, replace "shell having" with -- a shell having --.

Signed and Sealed this

Twenty-first Day of May, 2002

*Attest:*

*Attesting Officer*

JAMES E. ROGAN
*Director of the United States Patent and Trademark Office*